United States Patent [19]

Moynihan

[11] Patent Number: 4,874,296

[45] Date of Patent: Oct. 17, 1989

[54] COMPRESSOR ATTACHMENT FOR PORTABLE DRILL

[76] Inventor: Patrick B. Moynihan, 1517 Charlestown Dr., Edgewood, Md. 21040

[21] Appl. No.: 132,344

[22] Filed: Dec. 14, 1987

Related U.S. Application Data

[63] Continuation-in-part of Ser. No. 796,178, Nov. 8, 1985, Pat. No. 4,712,983.

[51] Int. Cl.[4] ..... F04B 21/00

[52] U.S. Cl. ..... 417/234; 417/415

[58] Field of Search ..... 417/234, 229, 415, 411, 417/410, 15, 16, 17, 366, 423 F; 74/670, 665 D, 665 Q, 49, 417, 665 C; 92/169, 170, 171, 31, 144

[56] References Cited

U.S. PATENT DOCUMENTS

| | | | |
|---|---|---|---|
| 1,381,686 | 6/1921 | Whigelt | 74/670 |
| 2,759,665 | 8/1956 | Wilber | 417/410 |
| 3,724,561 | 4/1973 | Merrels | 74/665 Q |
| 3,876,015 | 4/1975 | Kivela | 173/170 |
| 4,080,105 | 3/1978 | Connell | 417/26 |
| 4,187,058 | 2/1980 | Fish | 417/234 |
| 4,508,195 | 4/1985 | Millet | 184/28 |
| 4,516,561 | 5/1985 | Stawski et al. | 417/411 |
| 4,529,365 | 7/1985 | Schutt et al. | 417/415 |
| 4,616,983 | 10/1986 | Hanafi | 92/171 |
| 4,621,984 | 11/1986 | Fussell | 417/234 |

FOREIGN PATENT DOCUMENTS

| | | | |
|---|---|---|---|
| 0060887 | 2/1955 | France | 92/13.41 |

*Primary Examiner*—Carlton R. Croyle
*Assistant Examiner*—Robert N. Blackmon
*Attorney, Agent, or Firm*—Leonard Bloom

[57] ABSTRACT

A portable air compressor driven by an electric drill is disclosed. The compressor is rugged, reliable, and designed for economical mass-production for widespread marketing to professional mechanics and do-it-yourself home craftsmen. In one embodiment, a pair of "clam shell" mating housing halves enclose the crankcase and cylinder. In another embodiment, the "clam shell" halves are molded from a plastic material and are mounted on the rearward portion of a die-cast cylinder housing.

5 Claims, 5 Drawing Sheets

COMPRESSOR ATTACHMENT FOR PORTABLE DRILL

CROSS-REFERENCE TO RELATED APPLICATION

The present invention constitutes a continuation-in-part of application Ser. No. 796,178, filed Nov. 8, 1985, for "Air Compressor Accessory Driven By Portable Electric Drill" (and which will issue on Dec. 15, 1987, as U.S. Pat. No. 4,712,983) the disclosure of which is incorporated herein in its entirety.

BACKGROUND OF THE INVENTION

In my aforesaid application, Ser. No. 796,178, there is disclosed and claimed, a portable air compressor attachment adapted to be driven by the chuck of a portable power drill. The air compressor attachment includes a housing having a longitudinal axis; and a casing is disposed within the housing and has a longitudinal axis substantially aligned with the axis of the housing, such that the casing and housing have an annular space therebetween. The casing includes a cylinder, and a piston is guided for reciprocation in the cylinder along the longitudinal axis of the housing. A first shaft is journaled in the housing, substantially aligned with the longitudinal axis thereof, and the first shaft is driven by the chuck of the portable power drill. A second shaft is mounted in the housing, substantially at right angles to the first shaft, and first and second bevel gears are carried by the first and second shafts, respectively, to provide a speed increase therebetween. A suitable motion-converting means, such as a crank mechanism, is disposed between the second shaft and the piston; and air inlet and exhaust means are associated with the cylinder. The housing includes a forward portion, and a compressed air discharge means in the forward portion of the housing communicates with the air exhaust means and, preferably, is substantially aligned with the longitudinal axis of the housing. Accordingly, the portable power drill may be held in one hand of the user, while the air compressor attachment may be held in the other hand of the user, without regard to the heat generated by the reciprocation of the piston in the cylinder.

With this structure, the air compressor attachment (or accessory) is small, compact and lightweight and may be dropped into the tool box of a professional mechanic or a do-it-yourself ("D.I.Y.") home craftsman. The air compressor is readily driven by any motive power source, such as a power drill and, more particularly, a portable electric drill. Studies have shown that, in the United States, three out of four households have a power drill, and that nine out of ten "D.I.Y." households have a power drill. With this widespread availability of power drills, there are many uses in and around the home, garage, basement workshop, or lawn and garden for an air compressor driven by a power drill.

SUMMARY OF THE INVENTION

The present invention constitutes a further improvement over the aforesaid parent application, Ser. No. 796,178; and, more particularly, is intended to improve the performance and serviceability of the air compressor attachment and to reduce its manufacturing cost.

In accordance with the teachings of the present invention, there is herein illustrated and described a preferred embodiment thereof, of an air compressor attachment adapted to be driven by the chuck of a power drill, such that the power drill may be held in one hand while the air compressor attachment is held in the other hand. The air compressor includes a housing having a forward portion and a rearward portion, and further includes a pair of complementary mating halves secured together along a common longitudinal midplane. A drive shaft is journaled in the housing and extends rearwardly therefrom; preferably, the drive shaft has an axis substantially in the common longitudinal midplane of the housing halves, and the drive shaft is secured within the chuck of the power drill. A longitudinally-adjustable means is carried by the housing and engages the power drill to preclude the housing from rotating relative to the power drill. A crankcase is provided within the rearward portion of the housing. An eccentric crankshaft is provided within the crankcase, and a gear means is provided between the drive shaft and the crankshaft. A cylinder is formed within the forward portion of the housing, and a piston is guided for reciprocation within the cylinder; and means are provided for connecting the piston to the crankshaft. The cylinder has air inlet means and air exhaust means formed therein. An air discharge hose is carried by the forward portion of the housing and projects forwardly therefrom, and means are provided for connecting the air exhaust means in the cylinder to the air discharge hose.

Preferably, the crankcase and the cylinder are secured together, the cylinder being disposed forwardly of the crankcase, and a keying means is provided for keying the crankcase to the rearward portion of the housing. In a preferred embodiment, the keying means includes a ring carried by the crankcase, and each of the mating halves of the housing has a substantially semi-annular groove formed therein to receive the ring on the crankcase, the semi-annular grooves in the housing being axially aligned with each other. Preferably, an elastomeric ring is carried by the cylinder and is disposed between the complementary mating halves of the housing, thereby reducing vibration during operation of the compressor. Moreover, the housing is preferably provided with ventilating openings for the crankcase and cylinder.

Preferably, the gear means comprises a bevel gear step-up means In a preferred embodiment, the bevel gear step-up means comprises a pair of cooperating bevel gears providing a substantially 2:1 gear step-up. This may be especially useful for electric drills having an R.P.M. of around 900 at the output spindle or chuck, since an improved performance of the reciprocating piston in the cylinder may equate, substantially, to an output R.P.M. of 1800, depending upon the particular design or construction of the piston and the operating parameters thereof.

Preferably, the means carried by the housing and engaging the power drill (to preclude the housing from rotating relative to the power drill) includes at least one sleeve carried by one of the mating halves of the housing. A rod is slidably adjustable in the sleeve longitudinally of the housing, and means are provided for securing the rod to the sleeve in the desired adjusted longitudinal position of the rod. The rod has a rearward portion bent substantially right-angularly thereto and adapted to rest against the power drill externally thereof.

Viewed in another aspect, there is herein provided a compressor attachment for a power drill of the type having a chuck, wherein the power drill may be held in one hand while the compressor attachment is held in the other hand. The compressor attachment includes a housing molded from a plastic material and having a forward portion and a rearward portion. A drive shaft extends rearwardly of the housing, such that the drive shaft may be secured within the chuck of the power drill. Means including a longitudinally-adjustable rod is carried by the housing and engages the power drill to preclude the housing of the compressor attachment from rotating relative to the power drill. A crankcase is provided within the rearward portion of the housing. An eccentric is provided within the crankcase, and a gear means is disposed between the drive shaft and the crankshaft. A cylinder is provided within the forward portion of the housing. A reciprocating piston is disposed within the cylinder, and means are provided for connecting the piston to the crankshaft. The cylinder has air inlet means and air exhaust means formed therein. An air discharge hose is carried by the forward portion of the housing and projects forwardly therefrom, and means are provided for connecting the air exhaust means in the cylinder to the air discharge hose. Preferably, the housing further includes ventilating openings formed therein substantially adjacent to the cylinder.

These and other objects of the present invention will become apparent from a reading of the following specification, taken in conjunction with the enclosed drawings.

GENERAL DESCRIPTION OF THE PREFERRED EMBODIMENTS

Figure 1:
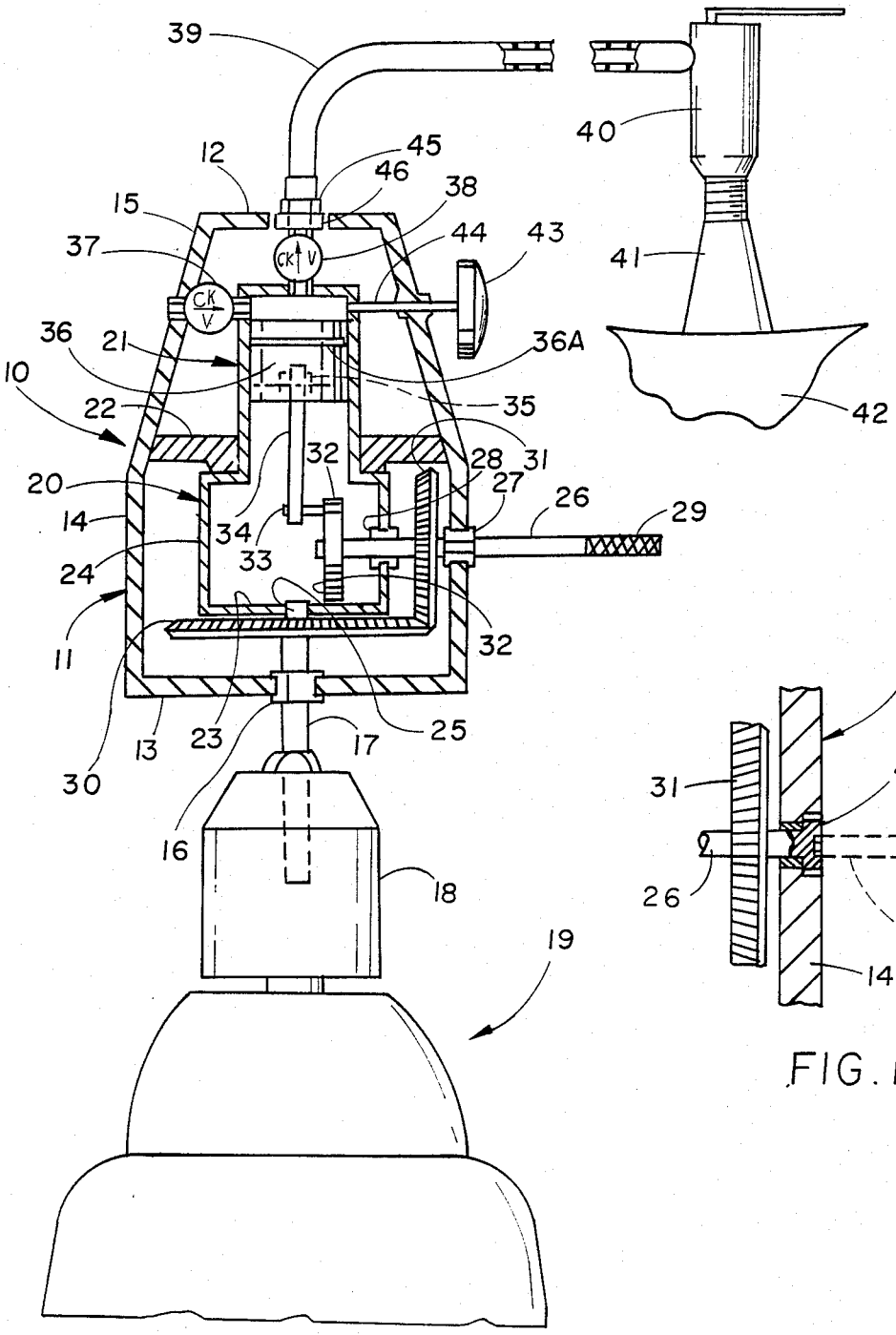
FIG. 1 is a longitudinal section of a first embodiment of the present invention, showing the air compressor attachment secured within the chuck of a power drill.

With reference to FIG. 1, the air compressor attachment (or accessory) 10 has a housing 11 including a front wall 12, a rear wall 13, and a side wall 14 including a forwardly-tapered cylindrical forward portion 15. A bearing 16 is mounted in the rear wall 13 of the housing 11, and a drive shaft 17 is journaled in the bearing 16. One end of the drive shaft 17 is mounted in the chuck 18 of a portable electric drill 19 (or other power drill or motive power source).

A crankcase 20 is mounted within the housing 11 of the air compressor 10. The forward portion of the crankcase 20 is reduced in diameter and is formed as a cylinder 21. A transverse web 22 (which may be made of a suitable material) supports the cylinder 21 within the housing 11. The crankcase 20 includes a rear wall 23 and a side wall 24. A bearing 25 is mounted in the rear wall 23 of the crank case 20 for journaling the end of the drive shaft 17. Thus the drive shaft 17 is journaled, fore and aft, in the bearings 16 and 25 in the rear walls 13 and 23 of the housing 11 and crankcase 20, respectively.

A stub shaft 26 (constituting a second drive shaft) is journaled in bearings 27 and 28 in the side walls 14 and 24 of the housing 11 and crankcase 20, respectively. The stub shaft 26 may be provided with knurls 29 for improved gripping by the chuck 18 of the power drill 19. The (first) drive shaft 17 may also be provided with similar knurls (not shown) if desired.

A first bevel gear 30 is carried by the drive shaft 17 (between the rear walls 13 and 23 of the housing 11 and crankcase 20, respectively) and a second bevel gear 31 is carried by the stub shaft 26 (between the side walls 14 and 24 of the housing 11 and crankcase 20, respectively). Preferably, the diameter of the first bevel gear 30 is substantially twice the diameter of the second bevel gear 31, so that the bevel gearing means 30, 31 provides a substantially 2:1 speed increase. This is desirable, since most d.i.y. power drills have an RPM of around 900 at the output spindle on which the chuck is mounted, so that the speed increases to around 1800 RPM which provides a better input speed (for the motion-converting means and the reciprocating piston, to be described herein). Alternatively, the stub shaft (or second drive shaft) 26 may be driven directly by the power drill 19 (or other motive power source).

The motion-converting means within the crankcase 20 includes a crank 32 carried by the end of the stub shaft 26, an eccentric pin 33 on the crank 32, a connecting rod 34 on the eccentric pin 33, and a pivot 35 between the piston 36 and the end of the connecting rod 34. The piston 36 carries a piston ring 36A (or grease groove) and reciprocates within the cylinder 21.

Air inlet and exhaust means are formed within (or associated with) the cylinder 21, including a first check valve means 37 for air intake and a second check valve means 38 for the air exhaust or discharge. A flexible hose 39 communicates the air discharge to a fitting 40 which is adapted to engage the valve stem 41 of an automobile tire 42 (or other inflatable device). A suitable pressure gage 43 has a connection 44 for indicating the air pressure within the cylinder 21. A hose coupling 45 (of plastic or brass) holds the hose 39 at the second check valve 38 for maintaining a pressure connection with an output nozzle 46.

Figure 1A:
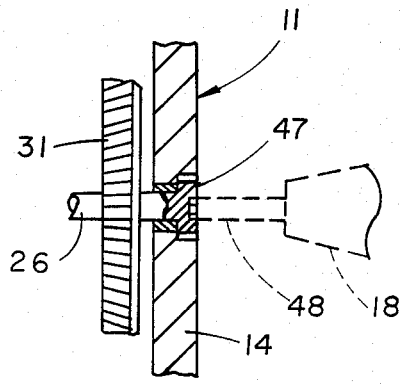
FIG. 1A is a second embodiment of the air compressor of the present invention, wherein the second right-angularly-disposed shaft is deleted and is replaced by an internal socket within the housing.

With reference to FIG. 1A, a second embodiment of the present invention is illustrated wherein the outwardly-protruding portion of the stub shaft (or second drive shaft) 26 is removed, and wherein the stub shaft 26 is provided with a female socket 47. With this arrangement, a hexagonal drive shaft 48 (constituting a male adapter) may be received within the socket 47 and chucked in the drill chuck 18 for driving the truncated stub shaft 26.

Figure 2:
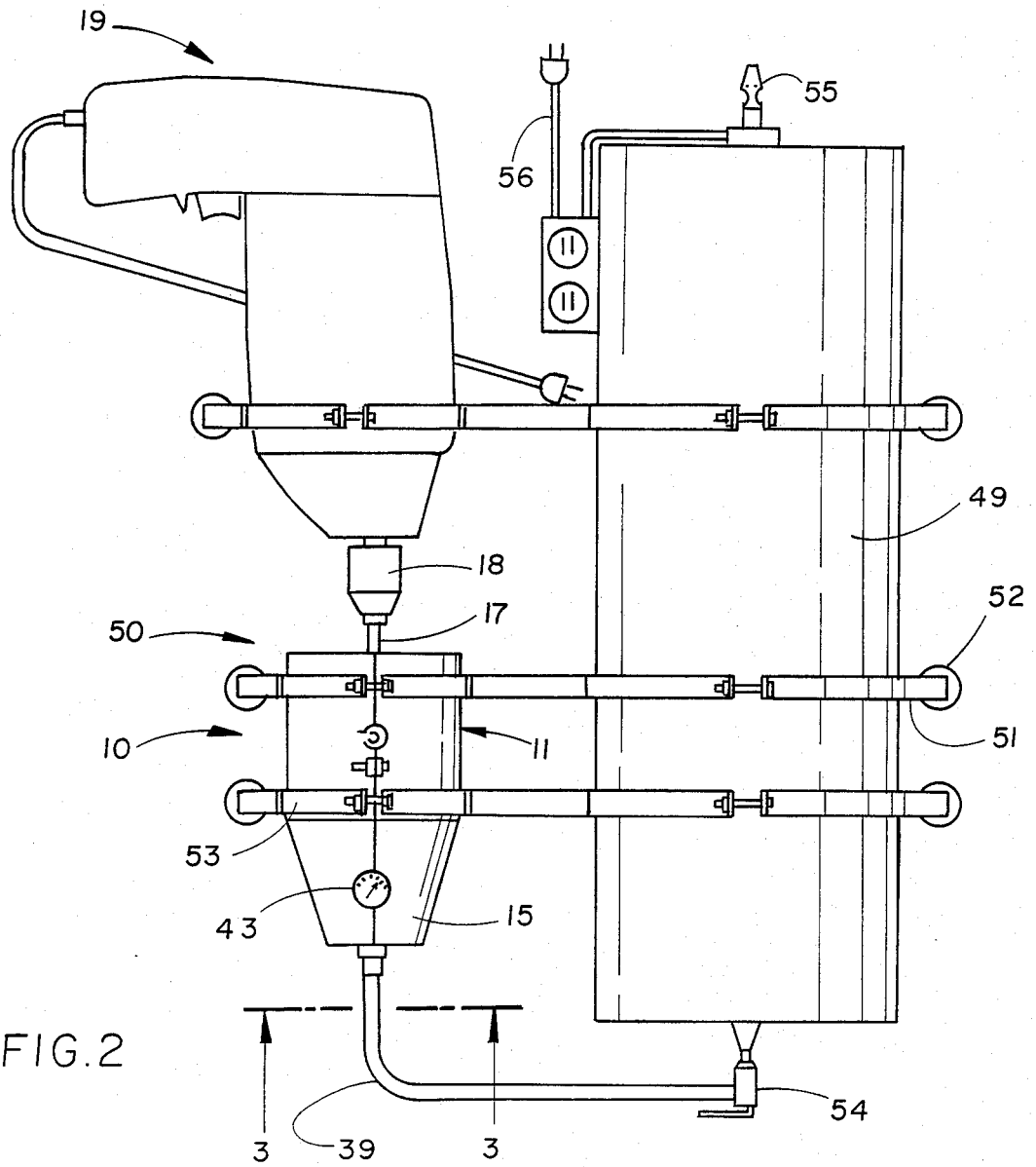
FIG. 2 illustrates the embodiment of FIG. 1 mounted within the frame of a distribution system for compressed air.
Figure 3:
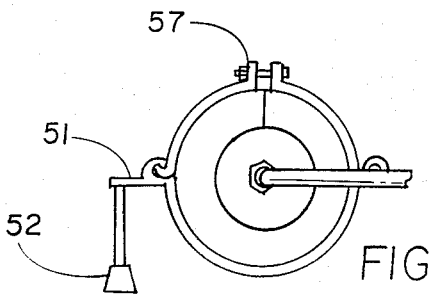
FIG. 3 is a section view thereof, taken along the lines 3—3 of FIG. 1.
Figure 4:
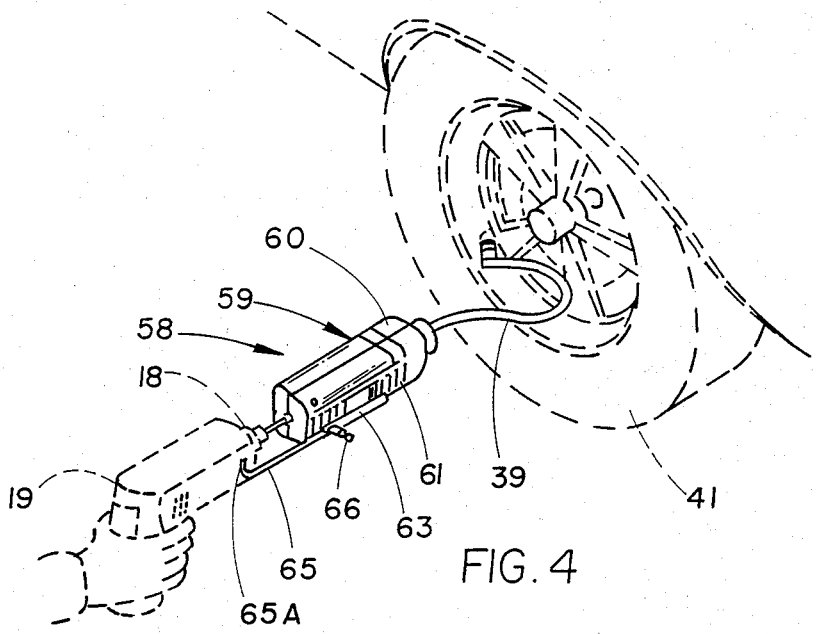
FIG. 4 is a perspective view of a third embodiment of the air compressor attachment of the present invention, showing the use thereof for inflating an automobile tire, the broken lines forming no part of the present invention.
Figure 5:
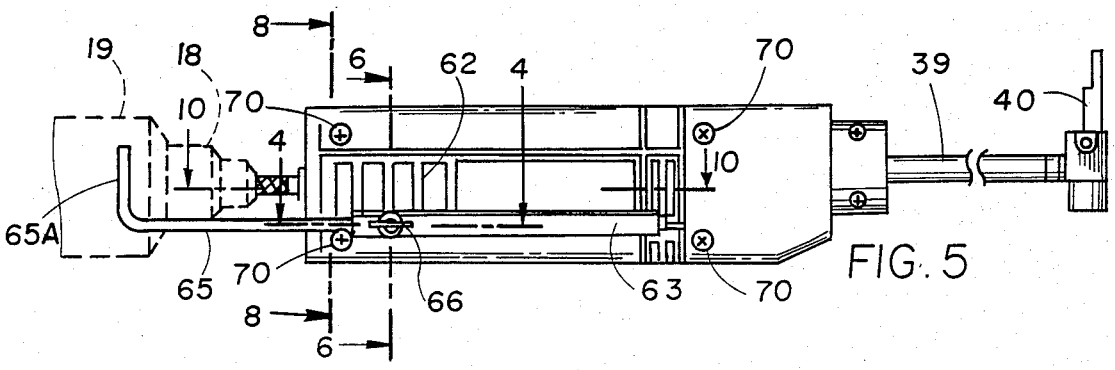
FIG. 5 is a right side elevational view of the embodiment of FIG. 4.
Figure 6:
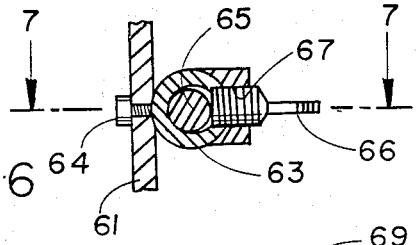
FIG. 6 is a detail section view thereof, takes across the lines 6—6 of FIG. 5 and drawn to an enlarged scale, and showing the mounting of a longitudinally-adjustable rod on the housing of the air compressor.
Figure 7:
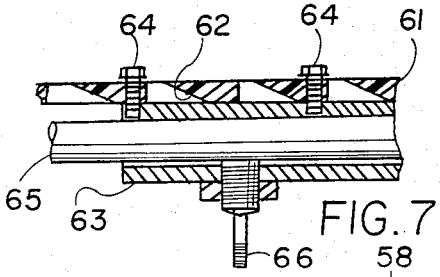
FIG. 7 is a section view, takes along the lines 7—7 of FIG. 6, and further showing the longitudinally-adjustable rod.
Figure 8:
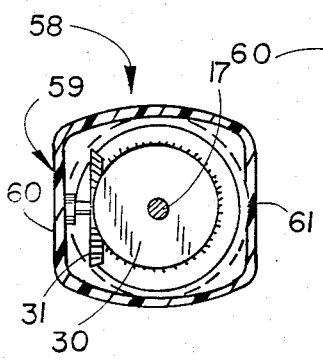
FIG. 8 is a section view, taken along the lines 8—8 of FIG. 5, showing the substantially rectangular cross-section of the housing for the air compressor, and further showing the cooperating bevel gears within housing.
Figure 9:
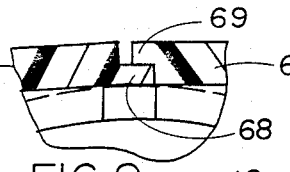
FIG. 9 is a portion of FIG. 8, drawn to an enlarged scale, and showing the cooperating ledges on the mating halves of the "clam shell" housing of the air compressor.
Figure 10:
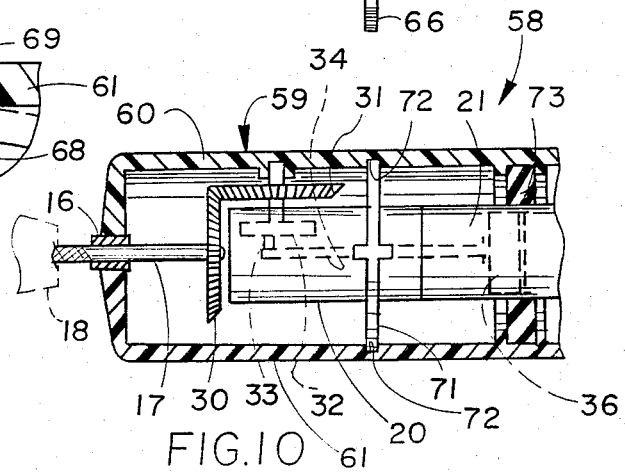
FIG. 10 is a longitudinal section of the air compressor, taken along the lines 10—10 of FIG. 5.

With reference to FIGS. 2 and 3, a cylindrical storage tank 49 is provided within a frame 50. The drill 19 may be swiveled in the frame 50, if desired, for connection to the drive shafts 17 and 26, respectively. The frame 50 includes cross numbers 51 provided with down-pointing feet 52 and connected to the tank 49 by hose-type clamps 53 looped over the frame 50. When the air compressor 10 and the electric hand drill 19 are secured to the frame 50, the entire unit may be manipulated conveniently by the pistol-grip hand drill 19. The hose 39 may be detachably secured at the free end to the inlet of the tank 49 by a conventional fitting 54, and the tank 49 may have an output hose fitting 55 at the opposite end thereof. The electric drill 19 may be driven from any convenient source, such as the house current (as at 56) or a suitable rechargeable battery (not shown) within the electric drill 19. A suitable conventional pressure switch may be used (if desired) to turn the outlet 55 on and off in accordance with the pressure in the tank 49 to thereby control pumping.

With reference to FIG. 3, the frame elements (cross members) 51 support the assembly as a unit and clamps 57 hold the frame elements. The tank 49 is the principal structural member of the frame 50.

With reference to FIGS. 4–10, a third embodiment of the present invention is illustrated, wherein the air compressor 58 has a "clam shell" housing 59 including a pair of complementary mating halves 60 and 61 which, preferably, are molded from a suitable plastic material. The housing 59 is provided with ventilating slots 62, as shown more clearly in FIG. 7. A sleeve 63 is secured to the housing 59 by a plurality of screws 64 (or, alternatively, is integrally molded with one of the housing halves 60–61) and a rod 65 is slidably mounted within the sleeve 63. The rod 65 is longitudinally adjustable within the sleeve 63 and relative to the housing 59, and the selected longitudinally-adjustable position of the rod 65 is retained by a thumb screw 66 engaging a tapped recess 67 formed within the sleeve 63. The rearward portion of the rod 65 has a right-angularly bent portion 65A adapted to rest against the housing of the power drill 19, thereby precluding the compressor 58 from rotating relative to the drill 19 during operation thereof. With this arrangement, the drill 19 and the compressor 58 may be placed on the floor of the garage or on the ground or driveway of the home, and left unintended during operation of the air compressor 58.

Preferably, the mating halves 60 and 61 of the housing 59 have cooperating longitudinal ledges 68 and 69, respectively; and the housing halves 60, 61 are retained by a plurality of screws 70. The screws 70 may be of the self-tapping type, if desired; and the screws 70 pass through the "upper" one of the housing halves and are received within corresponding bosses (not shown) formed in the "lower" one of the housing halves 60,61.

The crankcase 20 is retained within the housing 59 by means of a ring 71 received in cooperating axially-aligned semi-annular grooves (one of which is shown as at 72 in FIG. 10) formed in the housing halves 60,61. The cylinder 21 is formed integrally with (or otherwise secured to) the crankcase 20, and a resilient ring 73 is mounted within the housing 59 and surrounds the cylinder 21, as shown more clearly in FIG. 10.

In this embodiment (of FIGS. 4–10) the cooperating bevel gears 30 and 31, respectively, are of substantially the same size.

Figure 11:
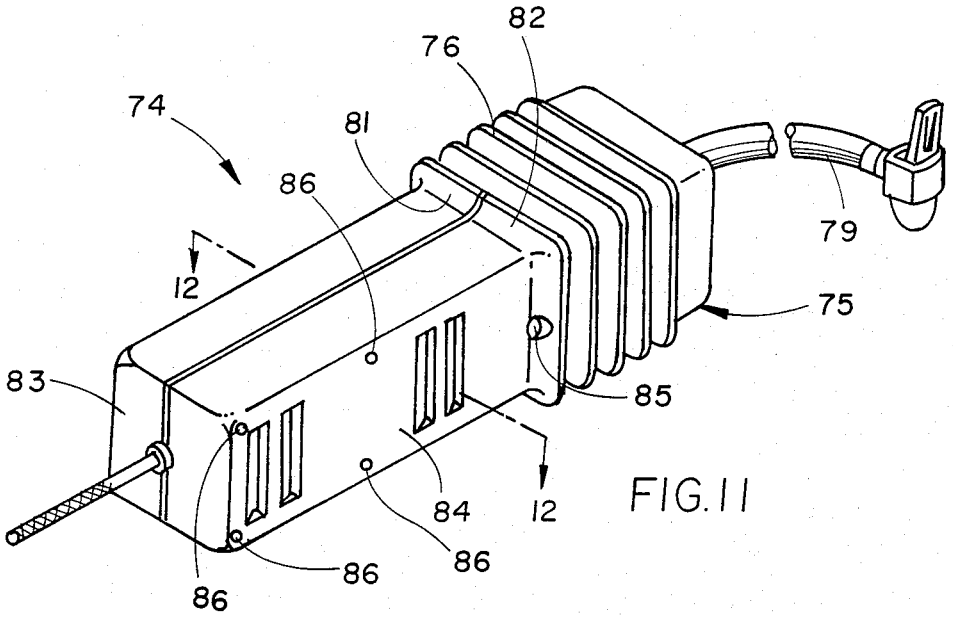
FIG. 11 is a perspective view of a fourth embodiment of the air compressor of the present invention.
Figure 13:
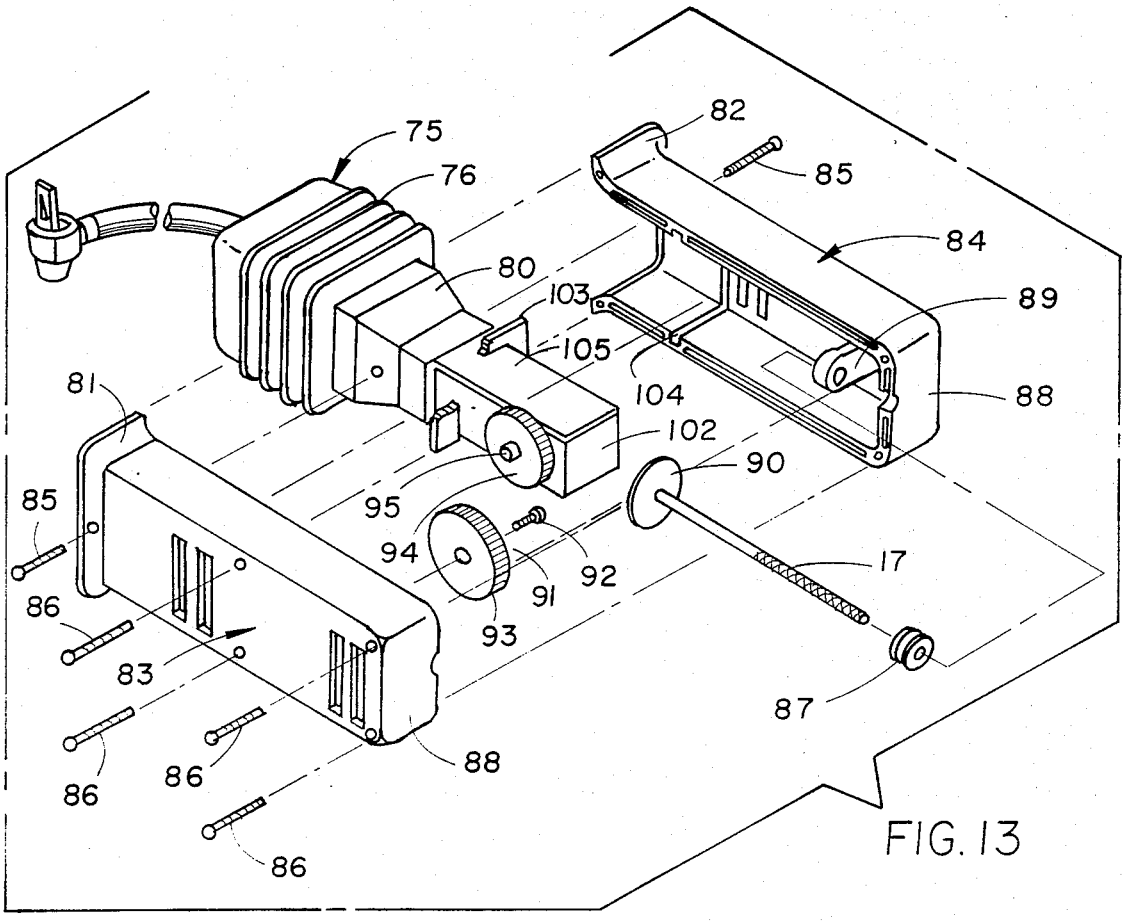
FIG. 13 is an exploded perspective view thereof.
Figure 12:
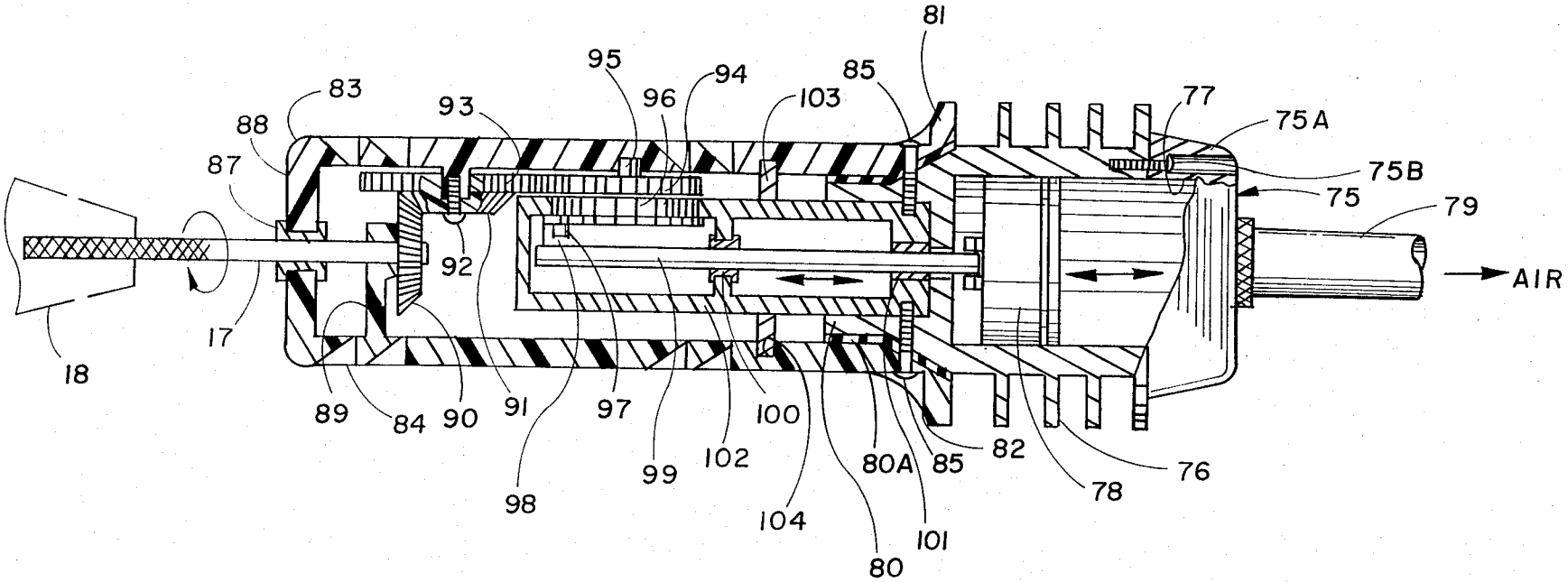
FIG. 12 is a longitudinal section thereof, taken along the lines 12—12 of FIG. 11.

With respect to FIGS. 11–13, a fourth embodiment of the present invention comprises an air compressor 74 having a forward housing portion 75 (provided with a cylinder head 75A secured thereto by screws, one of which is shown as in 75B in FIG. 12). The forward portion 75 may be die-cast of aluminum (or other suitable metal) and may be provided with heat-radiating fins 76 for cooling purposes. The die-cast forward housing portion 75 is suitably bored to form a cylinder 77 for the reciprocating piston 78. The air inlet and discharge means, being conventional, have been omitted for ease of illustration. An air discharge hose 79 cooperates with the piston 78 and cylinder 77 and extends forwardly of the compressor 74. The forward housing portion 75 has a rearwardly- projecting skirt 80, and the forwardly-extending portions 81 and 82 of the mating housing halves 83 and 84, respectively, are secured to the skirt 80 of the housing portion 75 by screws 85 (with a heat-insulating shield 80A therebetween). The housing halves 83 and 84 are also secured to each other by a plurality of screws 86.

The drive shaft 17 is journaled in a bearing 87 formed in the rear wall 88 of the housing halves 83 and 84, and the drive shaft 17 is further journaled in a bearing boss 89 formed integrally with housing half 84. A bevel gear 90 is carried on the end of the drive shaft 17 and meshes with a bevel gear 91 carried on a stub shaft 92. The stub shaft 92 also carries a spur gear 93 which meshes with a second spur gear 94 mounted on a second stub shaft 95. The second stub shaft 95 carries a crank 96 having an eccentric pin 97. The eccentric pin 97 is received in a transverse "Scotch yoke" 98 mounted on a reciprocating shaft 99. The reciprocating shaft 99 is guided for longitudinal reciprocation within spaced bearings 100 and 101 formed in a crank housing 102. The crank housing 102 is nested within the rear skirt portion 80 on the forward housing portion 75; and the crank housing 102 is secured to the rear skirt 80 by the screws 85.

The crank housing 102 is also supported by a plate 103 trapped between the housing halves 83 and 84, respectively. The plate 103 is received in cooperating grooves, one of which is shown as at 104 in housing half 84. The crank housing 102 also has a cover plate 105.

With this embodiment (of FIGS. 11–13) the air compressor is rugged and reliable and may be produced economically for widespread merchandising and distribution.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A compressor attachment for a power drill having a chuck, wherein the power drill may be held in one hand while the compressor attachment is held in the other hand, comprising a housing having a forward portion and a rearward portion and including a pair of complementary mating halves secured together along a common longitudinal midplane, a drive shaft journaled in the housing and extending rearwardly therefrom, the drive shaft having an axis substantially in the common longitudinal midplane of the housing halves, wherein the drive shaft may be secured within the chuck of the power drill, longitudinally-adjustable means carried by the housing and engaging the power drill to preclude the housing from rotating relative to the power drill, a crankcase within the rearward portion of the housing, an eccentric crankshaft within the crankcase, gear means between the drive shaft and the crankshaft, a cylinder within the forward portion of the housing, a piston within the cylinder, means for connecting the piston to the crankshaft, the cylinder having air inlet means and air exhaust means formed therein, an air discharge hose carried by the forward portion of the housing and projecting forwardly therefrom, and means for connecting the air exhaust means in the cylinder to the air discharge hose, wherein the means carried by the housing and engaging the power drill to preclude the housing from rotating relative to the power drill, comprises at least one sleeve carried by one of the mating halves of the housing, a rod slidably adjustable in the sleeve longitudinally of the housing, means for securing the rod to the sleeve in the desired adjusted longitudinal position of the rod, and the rod having a rearward portion bent substantially right-angularly thereto and adapted to rest against the power drill externally thereof.

2. A compressor attachment for a power drill having a chuck, wherein the power drill may be held in one hand while the compressor attachment is held in the other hand, comprising a housing having a forward portion and a rearward portion and including a pair of complementary mating halves secured together along a common longitudinal midplane, a drive shaft journaled in the housing and extending rearwardly therefrom, the drive shaft having an axis substantially in the common longitudinal midplane of the housing halves, wherein the drive shaft may be secured within the chuck of the power drill, at least one sleeve carried by one of the mating halves of the housing, a rod slidably adjustable in the sleeve longitudinally of the housing, means for securing the rod to the sleeve in the desired adjusted longitudinal position of the rod, the rod having a rearward portion bend substantially right-angularly thereto and adapted to rest against the power drill externally thereof, thereby precluding the housing from rotating relative to the power drill, a crankcase within the rearward portion of the housing, an eccentric crankshaft within the crankcase, step-up bevel gear means between the drive shaft and the crankshaft, a cylinder within the forward portion of the housing and connected to the crankshaft, a piston within the cylinder, means for connecting the piston to the crankshaft, the cylinder having air inlet means and air exhaust means formed therein, an air discharge hose carried by the forward portion of the housing and projecting forwardly therefrom, and means for connecting the air exhaust means in the cylinder to the air discharge hose.

3. A compressor attachment for a power drill having a chuck, wherein the power drill may be held in one hand while the compressor attachment is held in the other hand, comprising a housing having a forward portion and a rearward portion and including a pair of complementary mating halves secured together along a common longitudinal midplane, a drive shaft journaled in the housing and extending rearwardly therefrom, the drive shaft having an axis substantially in the common longitudinal midplane of the housing halves, wherein the drive shaft may be secured within the chuck of the power drill, at least one sleeve carried by one of the mating halves of the housing, a rod slidably adjustable in the sleeve longitudinally of the housing, means for securing the rod to the sleeve in the desired adjusted longitudinal position of the rod, the rod having a rearward portion bent substantially right-angularly thereto and adapted to rest against the power drill externally thereof, thereby precluding the housing from rotating relative to the power drill, a crankcase within the rearward portion of the housing, a ring carried by the crankcase, each of the mating halves of the housing having a substantially semi-circular groove formed therein to receive the ring on the crankcase, the semi-circular grooves in the housing being axially aligned with each other, thereby keying the crankcase to the housing, an eccentric crank case within the crankcase, step-up bevel gear means between the drive shaft and the crankshaft providing a substantially 2:1 step-up, a cylinder within the forward portion of the housing and connected to the crankshaft, an elastomeric ring carried by the cylinder and disposed between the complementary mating halves of the housing, thereby reducing vibration, a piston within the cylinder, means for connecting the piston to the crankshaft, the cylinder having air inlet means and air exhaust means formed therein, an air discharge hose carried by the forward portion of the housing and projecting forwardly therefrom, means for connecting the air exhaust means in the cylinder to the air discharge hose, and the housing being provided with ventilating openings for the crankcase and cylinder.

4. A compressor attachment for a power drill having a chuck, wherein the power drill may be held in one hand while the compressor attachment is held in the other hand, comprising a housing molded from a plastic material and having a forward portion and a rearward portion, a drive shaft extending rearwardly of the housing, wherein the drive shaft may be secured within the chuck of the power drill, means including a longitudinally-adjustable means carried by the housing and engaging the power drill to preclude the housing from rotating relative to the power drill, a crankcase within the rearward portion of the housing, an eccentric means within the crankcase, gear means between the drive shaft and the eccentric means, a cylinder within the forward portion of the housing, a piston within the cylinder, means for connecting the piston to the eccentric means, the cylinder having air inlet means and air exhaust means formed therein, an air discharge hose carried by the forward portion of the housing and projecting forwardly therefrom, means for connecting the air exhaust means in the cylinder to the air discharge hose, and the housing further including ventilating openings formed therein substantially adjacent to the cylinder.

5. The compressor attachment of claim 4, wherein the means connecting the eccentric means to the piston comprises, in combination, a reciprocating shaft slidably mounted in the crankcase, a transverse yoke on the reciprocating shaft, a pin in the yoke and connected to the eccentric means, and the piston being carried on the end of the reciprocating shaft.

* * * * *